US006841020B2

(12) United States Patent
Hebels et al.

(10) Patent No.: US 6,841,020 B2
(45) Date of Patent: Jan. 11, 2005

(54) METHOD OF AND APPARATUS FOR SPLICING RUNNING WEBS OF PAPER AND THE LIKE

(75) Inventors: Albert-Berend Hebels, Hamburg (DE); Frank Grothaus, Hamburg (DE); Franz Hartmann, Geesthacht (DE); Jens Collin, Hamburg (DE)

(73) Assignee: Hauni Maschienbau Aktiengesellschaft, Hamburg (DE)

( * ) Notice: Subject to any disclaimer, the term of this patent is extended or adjusted under 35 U.S.C. 154(b) by 0 days.

(21) Appl. No.: 10/635,020

(22) Filed: Aug. 6, 2003

(65) Prior Publication Data

US 2004/0129374 A1 Jul. 8, 2004

(30) Foreign Application Priority Data

Aug. 14, 2002 (EP) ..... 02018334
Aug. 14, 2002 (EP) ..... 02018339

(51) Int. Cl.[7] ..... B65H 21/00

(52) U.S. Cl. ..... 156/157; 156/504; 242/554.6; 242/555; 242/556

(58) Field of Search ..... 242/551, 554, 242/554.5, 554.6, 555, 556; 156/157, 159, 502, 504

(56) References Cited

U.S. PATENT DOCUMENTS 3,061,220 A * 10/1962 Gagg et al. ..... 242/553
3,089,661 A 5/1963 Phillips, Jr. et al.
3,252,671 A * 5/1966 Phillips, Jr. et al. ..... 242/553
4,236,538 A * 12/1980 Foster et al. ..... 131/370
5,060,665 A 10/1991 Heitmann
5,072,742 A 12/1991 Heitmann
5,131,593 A * 7/1992 Siegfried et al. ..... 156/504
5,360,502 A * 11/1994 Andersson ..... 156/159
5,442,897 A 8/1995 Hinzmann et al.
6,030,496 A 2/2000 Baggot et al.
6,051,095 A 4/2000 Butterworth
6,082,661 A * 7/2000 Focke et al. ..... 242/556.1
6,578,616 B2 * 6/2003 Stein et al. ..... 156/504

FOREIGN PATENT DOCUMENTS

| | | |
|---|---|---|
| DE | 1 995 937 | 8/1968 |
| DE | 1 532 203 | 1/1970 |
| DE | 1 532 204 | 1/1970 |
| DE | 693 00 282 T2 | 3/1996 |
| DE | 100 43 984 A1 | 3/2001 |
| DE | 100 12 000 A1 | 9/2001 |

* cited by examiner

*Primary Examiner*—Mark A. Osele
(74) *Attorney, Agent, or Firm*—Venable LLP; Robert Kinberg; Catherine M. Voorhees

(57) ABSTRACT

The leading end of a running fresh web of cigarette paper or the like is spliced to the trailing end of a running expiring web while the ends travel at the same speed, in the same direction and next to each other. The splicing unit includes a rotatable roll at one side of the path for the advancing ends, and a rotary carrier at the other side of such path opposite the roll. The carrier is provided with a segment having a convex knurling surface which cooperates with the peripheral surface of the roll to provide the webs with a splice while the segment engages the adjacent web. Prior to splicing, the carrier is rotated in a first direction to move the segment away from the path for the webs, and such movement is followed by rotation of the carrier in a second direction to accelerate the knurling surface at least close (a) to the common speed of the webs and (b) at least close to the speed of the peripheral surface of the roll. Those remnants of the webs which project beyond the splice are separated from the webs, preferably by tearing.

33 Claims, 6 Drawing Sheets

METHOD OF AND APPARATUS FOR SPLICING RUNNING WEBS OF PAPER AND THE LIKE

CROSS-REFERENCE TO RELATED CASES

This application claims the priorities of the commonly owned copending European patent applications Serial Nos. 02 018 334.9 and 02 018 339.8, both filed Aug. 14, 2002. The disclosures of the: above-referenced European patent applications, as well as that of each US and/or foreign patent and/or patent application identified in the specification of the present application, is incorporated herein by reference.

BACKGROUND OF THE INVENTION

The present invention relates to improvements in methods of and in apparatus for splicing together running webs of paper or the like, e.g., webs of paper or other wrapping material for use in the making of plain or filter cigarettes, cigars, cigarillos and/or other rod-shaped smokers' products. More particularly, the invention relates to improvements in methods of and in apparatus for splicing trailing ends of expiring webs or strips of paper or the like to leading ends of fresh webs in such a way that the leading and trailing ends need not be adhesively and/or thermally secured to each other. Still more particularly, the invention relates to improvements in methods of and in apparatus for securing the leading and trailing ends of pairs of running webs or strips of deformable material to each other while the two ends advance lengthwise, in the same direction, adjacent one another, at or close to identical speeds and are pressed against each other. Splicing undertakings of such character include folding and knurling.

Methods and apparatus for splicing the leading ends of fresh running webs to the trailing ends of expiring running webs are resorted to, among others, in the tobacco processing industry, e.g., to connect the leader of a rotating fresh bobbin or reel of convoluted cigarette paper to the trailing end of a rotating nearly expired bobbin or reel of cigarette paper in such a way that the delivery of cigarette paper to the wrapping station of a cigarette maker need not be interrupted or decelerated. This greatly reduces the number of rejects and enhances the output, especially in modern high-speed machines which are designed to turn out well in excess of 10,000 rod-shaped smokers' products per minute.

Presently known methods and apparatus of the above outlined character are disclosed, for example, in the assignee's German patent No. 693 00 282, Utility Model No. 1 995 937 and published German patent applications Nos. 1 532 203 and 1 532 204. U.S. Pat. No. 3,089,661 granted May 14, 1963 to Malcolm E. Phillips, Jr. et al. discloses an automatic cigarette paper splicer wherein a fresh convoluted cigarette paper web is accelerated to the speed of a running (expiring) cigarette paper web by taking into consideration the mass of the supply (such as a bobbin) of fresh convoluted web, the speed of the expiring bobbin of convoluted web and the tensional strength of the webs. Two rotary splicing sectors are provided to connect the leading end to the trailing end when the speed of the leading end matches that of the trailing end as well as the peripheral speeds of the sectors. The splicing involves or can involve one revolution of each sector about its respective axis. The final steps of the patented splicing operation include the severing of those (foremost and rearmost) ends of the spliced-together webs which respectively extend forwardly and rearwardly of the finished splice. Such final steps are carried out by knives which are actuated in dependency upon the positions of the splicing sectors.

An advantage of the automatic splicer which is disclosed in the U.S. Pat. No. 3,089,661 to Phillips et al. is that the operation of the web processing machine (e.g., a machine which confines a continuous rod-like filler of natural, substitute or reconstituted tobacco in a continuous web of cigarette paper or the like) need not be interrupted when the supply of a reel of convoluted web-like wrapping material is exhausted, i.e., that the splicing operation can be carried out while the expiring web and the fresh web are being moved at the prescribed speed of the wrapping material entering the processing machine.

Another known mode of splicing the leader of a fresh web to the trailing end of a moving expiring web in a cigarette maker is to resort to a magazine which is designed to temporarily store a length of the expiring web. Such proposals are not entirely satisfactory because the magazine takes up a substantial amount of space in a cigarette making or like plant wherein hundreds of wrapping machines are confined in a common hall.

OBJECTS OF THE INVENTION

An important object of the present invention is to provide a novel and improved method of splicing the running trailing end of an expiring web of paper or the like to the running leader of a fresh web in a novel and improved way, particularly as concerns the appearance and strength of the splices.

Another object of the instant invention is to provide a method which can be practiced with advantage in connection with the making of wrapped tobacco products and which can be carried out without resorting to magazines or similar bulky facilities for temporary storage of looped and/or otherwise deformed webs of wrapping material.

A further object of the invention is to provide a novel and improved apparatus for the practice of the above outlined method.

An additional object of the invention is to provide the apparatus with a novel and improved mechanism for making a pressure splice between the continuously advancing trailing end of an expiring web of paper or the like and the continuously advancing leading end of a fresh web.

Still another object of the invention is to reduce the number of rejects among the products which are obtained by draping a composite running web around a rod-shaped tobacco filler or the like.

A further object of this invention is to provide a novel and improved method of as well as a novel and improved arrangement for trimming the front and/or rear ends of splices between selected portions of an expiring web and a fresh web.

Another object of our invention is to provide a novel and improved method and a novel and improved apparatus of the above outlined character which can be incorporated into or otherwise combined with presently known methods of and/or apparatus for wrapping commodities into, or for otherwise associating commodities with, continuous running webs of paper, plastic material or the like.

SUMMARY OF THE INVENTION

One feature of the present invention resides in the provision of a method of splicing the trailing end of an expiring running web to the leading end of a fresh running web. The improved method comprises the steps of advancing the leading and trailing ends in at least substantial parallelism with and next to each other at an at least substantially identical speed and in a predetermined direction along a path which is flanked by a rotary arcuate knurling surface and by a rotary countersurface, moving the knurling surface—for example, counter to the predetermined direction—and maintaining it out of contact with the webs in the path, thereupon turning the knurling surface in the predetermined direction and simultaneously accelerating the knurling surface to the speed of the webs in the path, and thereafter pressing the leading and trailing ends of the webs against each other by and between the knurling surface and the countersurface.

The webs can form part of and can be paid out by discrete expiring and fresh bobbins or reels of convoluted webs consisting of paper or the like. For example, such webs can consist of wrapping material for smokers' products.

At least one of (a) the speed of the accelerated knurling surface, (b) the acceleration of the knurling surface, and (c) the position of the knurling surface can vary as a function of time with a harmonic progress adapted to be represented essentially by a sinusoidal function. For example, the harmonic progress of the position of the knurling surface can be represented by a function $s \cong a.\sin(t)+b.\sin(3t)+c.\sin(5t)$, wherein t is the time and a, b and c are constants.

The step of moving the knurling surface preferably counter to the predetermined direction can include causing the knurling surface to turn through an angle of less than 360°, for example, an angle which at least approximates 300°. Such step of moving the knurling surface can include moving the surface along an at least substantially circular path.

The step of accelerating the knurling surface can result in movement of such surface in at least substantial synchronism with the webs in the course of the pressing step.

The step of turning the knurling surface can include accelerating the knurling surface to at least close to the at least substantially identical speed of the webs and at least substantially independently of the countersurface.

The steps of moving an turning the knurling surface can include (a) moving the knurling surface from a starting position counter to the predetermined direction to a first intermediate position, (b) turning the knurling surface from the first intermediate position in the predetermined direction and simultaneously accelerating the knurling surface to at least close to the at least substantially identical speed of the webs in the path not later than when the knurling surface reaches the path of the webs, (c) decelerating the knurling surface while moving it to a second intermediate position, and (d) thereafter moving the knurling surface to a final position. Such final position can coincide, at least substantially, with the starting position of the knurling surface. The knurling surface can be disposed at a maximum distance from the path of the webs while occupying the starting and/or the final position. Furthermore, the knurling surface can be disposed at a minimum distance from the path of the webs while occupying the one and/or the other intermediate position; at such time, the knurling surface does not contact the nearer of the two webs in their path.

The pressing step can entail the provision of at least one remnant which is of one piece with the webs. The remnant can include the foremost portion of the fresh web (i.e., that leader of the fresh web which extends forwardly beyond the splice) or the remnant of the expired web (namely that portion of the expired web which extends rearwardly of and beyond the splice). If the pressing step results in the provision of such remnant(s), the novel method can include the additional step of separating the remnant(s) from the spliced-together webs.

The separating step can include tearing the at least one remnant from the spliced-together webs. Such tearing step can include moving the at least one remnant at a first speed and moving the spliced-together webs at a different second speed. The first speed can exceed the second speed if the remnant extends forwardly of the freshly formed splice.

Alternatively, the separating step can include braking the at least one remnant relative to the spliced-together webs; such procedure can be resorted to if the remnant is part of the expiring web and extends rearwardly of and beyond the splice.

The advancing step of the improved method can include moving the ends of the webs at a first speed, and the separating step of such method can include accelerating the at least one remnant to a speed exceeding the first speed. The accelerating step can be started during a stage including one of (a) the pressing step, and (b) subsequent to completion of the pressing step.

Another feature of the present invention resides in the provision of an apparatus for splicing the trailing end of an expiring running web to the leading end of a fresh running web while the leading and trailing ends advance next to each other, in the same direction and at an at least substantially identical speed along a predetermined path. The improved apparatus comprises a rotary splicing member which is adjacent one side of the path for the webs and has a web knurling surface, regulatable drive means (e.g., a variable-speed electric motor) for the splicing member, and means for regulating the drive means to move the knurling surface of the splicing member in a first direction away from the path for the webs, to thereupon move the knurling surface in a second direction counter to the first direction and toward the path for the webs with simultaneous acceleration of the knurling surface at least close to the preferably identical speed of the webs in their path, and to thereafter move the thus accelerated knurling surface in the second direction against and with one of the webs in the path.

The splicing member preferably includes a segment which is rotatable about a predetermined axis and has a convex radially outermost surface which includes or constitutes the knurling surface.

The improved apparatus can further comprise a second splicing member having a second surface movable along and contacting the other web at the other side of the path for the webs opposite the first mentioned splicing member, at least while the knurling surface contacts the one web in the path. The second splicing member can include a roll which is rotatable about a second axis and has a peripheral surface including or constituting the second surface.

If the splicing operation is carried out in such a way that at least one of the spliced-together webs includes a remnant extending beyond the spliced-together portions of the webs in their path, the apparatus can further comprise means for separating the remnant of the at least one web not later than upon completed splicing of the webs to each other. The separating means can include means for tearing the remnant from the at least one web, and such tearing means can include means for moving the remnant of the at least one web and the spliced-together portions of the webs relative to each other at different speeds.

As already mentioned hereinbefore, the improved apparatus can further comprise a second rotary splicing member, and the path for the two webs then extends between the two splicing members. Each splicing member can include a roll, and such rolls are rotatable about at least substantially parallel axes. The first splicing member can further include a segment which is borne by the respective roll, and the knurling surface is then provided on such segment. The apparatus can further comprise second drive means (e.g., a second variable-speed electric motor) for the expiring web and third drive means (such as a further variable-speed electric motor) for the fresh web. The separating means of such apparatus can include a brake which is actuatable by the regulating means to oppose advancement of a remnant of the expiring web by the second drive means and the separating means can be arranged to separate a remnant from the fresh web by way of the third drive means. For example, the regulating means can be arranged to accelerate a remnant from the fresh web by way of the third drive means.

An advantage of the separating means is that it ensures removal of extraneous web material before the splice enters the apparatus or machine wherein the webs are processed, e.g., a cigarette making machine, a filter cigarette making machine, a tampon making machine (see, for example, U.S. Pat. No. 5,442,897 granted Aug. 22, 1995 to Alfred Hinzmann et al.) or the like.

The novel features which are considered as characteristic of the present invention are set forth in particular in the appended claims. The improved apparatus itself, however, both as to its construction and the mode of assembling, installing and utilizing the same, together with numerous additional important and advantageous features and attributes thereof, will be best understood upon perusal of the following detailed description of certain presently preferred specific embodiments with reference to the accompanying drawing.

DESCRIPTION OF PREFERRED EMBODIMENTS

Figure 1:
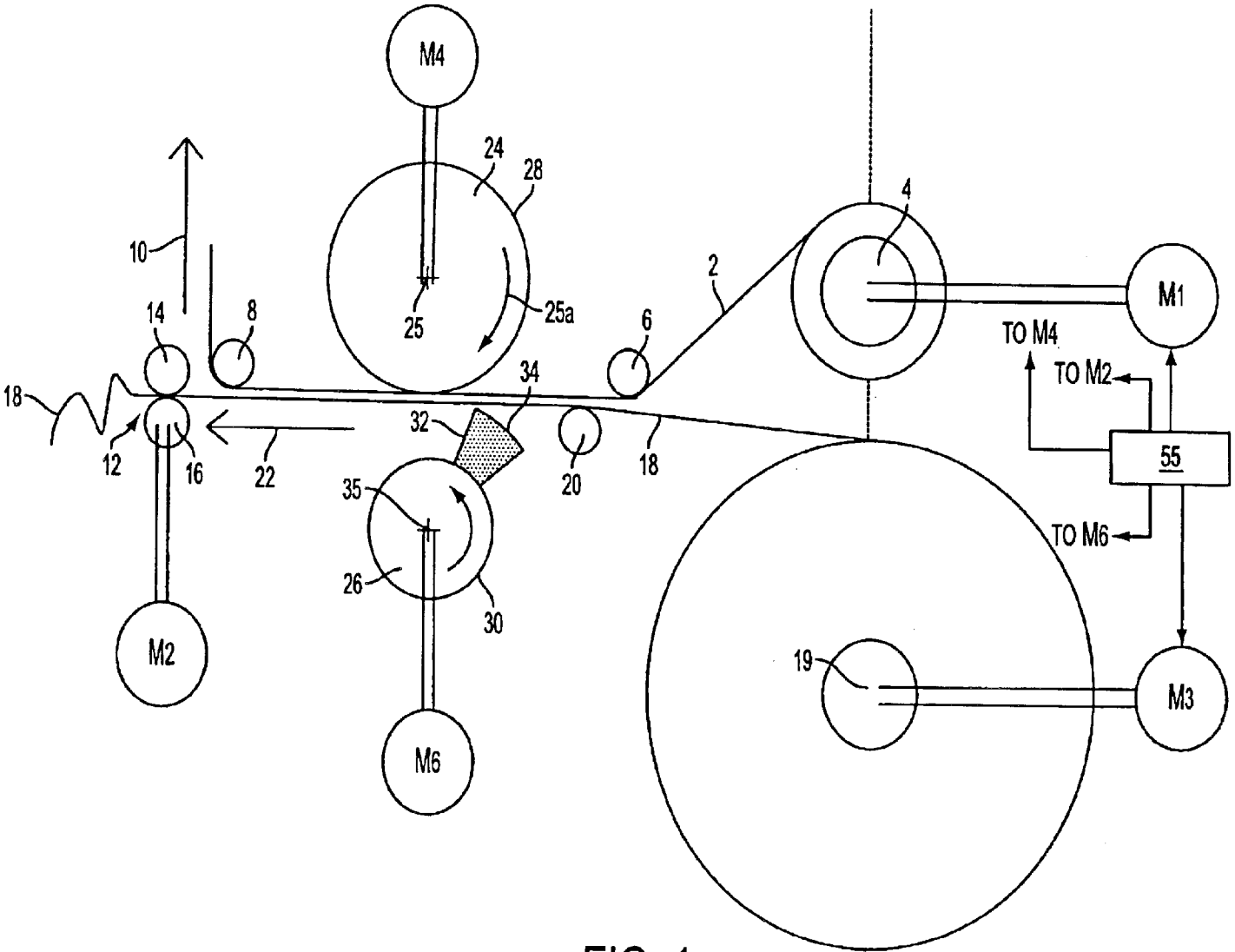
FIG. 1 is a schematic elevational view of an apparatus which embodies one form of the present invention.

FIG. 1 shows a first embodiment of the improved splicing apparatus. A first strip or web 2 (e.g., of cigarette paper, uniting band paper for the making of filter cigarettes or the like) is supplied by a first (expiring) bobbin or reel 4 which is rotated by a first prime mover or drive M1 (e.g., a variable-speed electric motor or the like). The leader of the web 2 is pulled (in the direction of arrow 10) by a device (not shown) which can form part of a wrapping mechanism in a consuming or processing machine, e.g., a cigarette rod making machine wherein the web is draped around a continuous rod-like filler of natural or substitute tobacco or another suitable smokable material. Reference may be had, for example, to commonly owned U.S. Pat. No. 5,060,665 (granted Oct. 29, 1991) and U.S. Pat. No. 5,072,742 (granted Dec. 17, 1991) to Heitmann which show wrapping mechanisms adapted to receive a continuous cigarette paper web from an apparatus of the type shown in FIG. 1.

The web 2 is trained over two spaced-apart parallel rollers 6, 8 to advance along an elongated path extending between these rollers and leading toward the consuming or processing machine. When the supply of web 2 on the core of the reel 4 is about to expire, its trailing end (which is then located between the rollers 6, 8) is spliced to the leading end of a fresh web or strip 18 furnished by a new bobbin or reel 19 which is adapted to be driven by a prime mover M3, e.g., a variable-speed electric motor. The leader of the fresh web 18 is threaded into the apparatus of FIG. 1 in such a way that it is trained over a roller 20 on its way into the nip of two driven rollers 14, 16 together forming a pair 12. At least one of the rollers 14, 16 is or can be directly driven by a variable-speed prime mover M2, e.g., an electric motor.

The rollers 20 and 14, 16 are positioned in such a way that a length or stretch of the leader of the fresh web 18 is at least substantially parallel with and closely adjacent to the length of the web 2 between the rollers 6 and 8. When the motors M2, M3 are on, the leader of the web 18 advances in the direction of arrow 22, i.e., in the direction of advancement of successive increments of the expiring web 2 from the roller 6 toward and beyond (arrow 10) the roller 8.

The path of the webs 2, 18 between the rollers 6, 8 and 20, 12 respectively is flanked by two rotary drum-shaped carriers 24, 26 (hereinafter called rolls) which are rotatable simultaneously with and/or independently of each other about parallel axes 25, 35 by additional variable-speed drive means (e.g., electric motors) M4 and M6. The motor M4 is arranged to rotate the roll 24 in a clockwise direction (arrow 25*a*) so that successive increments of its cylindrical peripheral surface 28 (e.g., a smooth cylindrical surface) advance into contact with the exposed (in FIGS. 1 and 2 upper) side of the web 2 midway or substantially midway between the rollers 6 and 8. The carrier 24 is part of the knurling device (splicing tool) which serves to splice the leader of the expiring web 2 to the trailing end of the fresh web 18 when the need for such operation arises, e.g., when a suitable monitoring device detects that the supply of running web 2 is about to expire.

The knurling device further comprises a second part 32 which is an arcuate segment projecting radially outwardly beyond the exposed peripheral surface 30 of the roll 26. The radially outermost portion of the segment 32 has an arcuate convex knurling surface 34 which can cooperate with the roll 24 to splice the leader of the fresh web 18 to the trailing end of the expiring web 2.

The schematically illustrated control unit 55 for the motors M1 to M4 and M6 is designed to operate these motors in a manner to be described with reference to FIGS. 2 and 3. This control unit is or can be analogous to that shown in FIG. 4, as at 55A.

As already mentioned hereinbefore, the trailing end of the expiring web 2 (namely the web portion between rollers 6 and 8) must be spliced (in the apparatus of FIG. 1 by knurling) to the leader of the fresh web 18 (namely to that portion of the web 18 which is then located between the rollers 20 and 14, 16). At such time, the speed of the trailing end of the expiring web 2 between the rollers 6, 8 at least approximates the speed of the leader of the fresh web 18 between the rollers 20 and 14, 16 (pair 12). Furthermore, the direction of movement (arrow 22) of the leader of the fresh web 18 matches the direction of movement of the trailing end of the expiring web 2. The leading end of the web 18 is closely or immediately adjacent the trailing end of the web 2. This is accomplished in that the circuitry of the control unit 55 for the motors M1 to M4 and M6 causes the motor M4 to accelerate the peripheral surface (countersurface) 28 of the roll 24 to the forward speed (arrow 22) of the adjacent portion (trailing end) of the web 2. At the same time, the motor M2 causes the rollers 14, 16 of the pair 12 to accelerate the leader of the fresh web 18 to the speed of the trailing end of the web 2. In order to carry out a satisfactory splicing (knurling) action, successive increments of the convex surface 34 of the segment 32 on the roll 26 must be caused to advance along and in contact with the outer side (underside in FIG. 1) of the leader of the fresh web 18 at or very close to the speed of advancement of the web 2 in the direction of arrow 22.

The exact novel mode of operation of the apparatus of FIG. 1 will be described with reference to FIGS. 2*a* to 2*h* wherein the reference numerals identify component parts and other features (such as directions of movement) already described with reference to FIG. 1. More specifically, FIGS. 2*a* to 2*h* illustrate numerous angular positions of the roll 26 and its segment 32 relative to the path of movement of the leader of the fresh web 18 and the trailing end of the expiring web 2, i.e., relative to the path of movement of the trailing end of the web 2 between the rolls 6, 8 and of the path of movement of the leader of the web 18 between the roll 20 and the pair 12 (rolls 14, 16). In accordance with a novel feature of the method and apparatus of the present invention, the convex knurling surface 34 of the segment 32 is caused to advance counterclockwise in the direction indicated by arrows 40 and 42 (to be simultaneously accelerated to the common speed of the webs 2, 18 in the path between the rollers 6, 14) subsequent to a clockwise angular movement (arrow 38) from the angular position shown in FIG. 2*a* to the angular position shown in FIG. 2*b*. This provides additional time and room for acceleration of the convex peripheral surface 34 from zero speed (FIG. 2*b*) to the speed of the web 18 (FIG. 2*e*). The angular displacement of the segment 32 from the position of FIG. 2*b* to the position of FIG. 2*e* can amount to approximately 300°, i.e., to somewhat less than a full revolution of the roll 26 about the axis 35 in a counterclockwise direction (arrows 40 and 42).

Figure 2A:
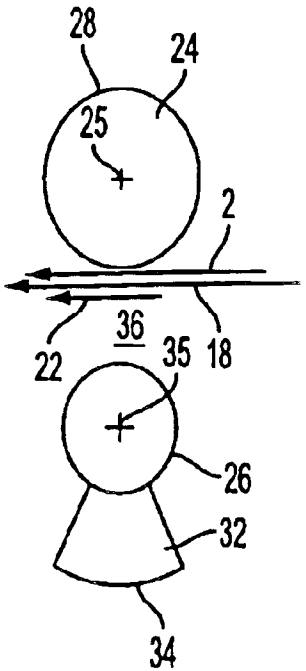
FIG. 2 (composed of FIGS. 2*a* to 2*h*) illustrates several successive positions of the splicing instrumentalities when the apparatus of FIG. 1 is in use to connect the leading end of a fresh web of convoluted cigarette paper or the like to the trailing end of an expiring web.

FIG. 2*a* shows the segment 32 at a standstill in or close to the 6 o'clock position. This ensures that the segment 32 is located at or close to a maximum distance from the roll 24 so that the clearance or gap 36 (shown in FIG. 2*a*) assumes a maximum width or height and permits for convenient threading of the leader of the fresh web 18 along the upper side of the roller 20 and into the nip of the rollers 14, 16 constituting the pair 12. At the same time, the then maximum-width gap 36 allows for unimpeded advancement of the expiring web 2 from the roller 6, in the direction of the arrow 22, around the roller 8 and in the direction of arrow 10 (i.e., into the processing or consuming machine).

Figure 2B:
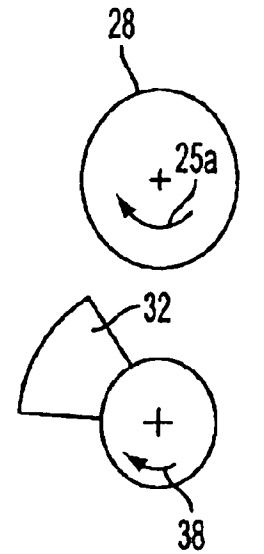
Figure 2C:
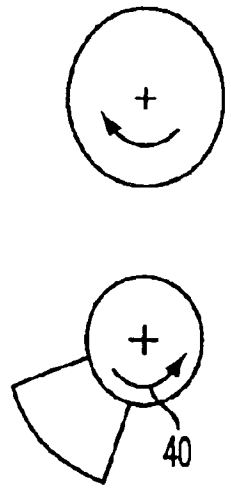
Figure 2D:
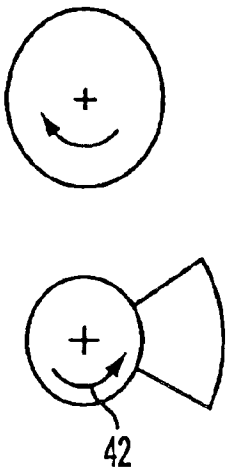
Figure 2H:
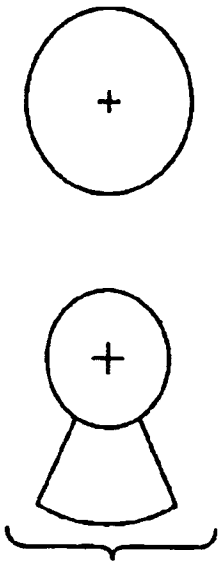

The next step involves clockwise indexing of the roll 26 and segment 32 in the direction of arrow 38, namely from the position of FIG. 2*a* to that shown in FIG. 2*b*. This can amount to a clockwise angular displacement of the roll 26 through approximately 120° from the six o'clock position of FIG. 2*a* to the ten o'clock position of FIG. 2*b*. The direction of rotation of the roll 26 by the motor M6 is thereupon reversed to counterclockwise direction (see the arrow 40 in FIG. 2*c* and the arrow 42 in FIG. 2*d*) and, at the same time, the segment 32 is accelerated so that its convex knurled surface 34 reaches the speed of the fresh web 18 (between the rollers 20, 16 and opposite the roll 24) not later than in the position which is shown in FIG. 2*e*, i.e., when the convex surface 34 is invariably caused to subject the leader of the web 18 to optimum (such as maximum) deformation and to urge such leader against the trailing end of the web 2 at the locus where the web 2 bears upon the cylindrical surface 28 of the roll 24. This results in the formation of a knurled splice, i.e., of a splice which prevents separation of the webs 2, 18 from each other during advancement in the direction of the arrow 10 toward and into the consuming or processing machine.

The acceleration of knurling surface 34 from zero speed (see the position of FIG. 2*b*) to the speed of the leader of the web 18 (FIG. 2*e* or somewhat earlier) can take place while the motor M6 rotates the roll 26 counterclockwise through an angle of approximately 300°. When the surface 34 contacts the leader of the fresh web 18 (i.e., during splicing as shown in FIG. 2*e*), the speed of successive increments at the top of such surface in the direction of arrow 22 at least approximates the identical or substantially identical speed of the webs 2, 18 between the rollers 6 and 8.

Figure 2G:
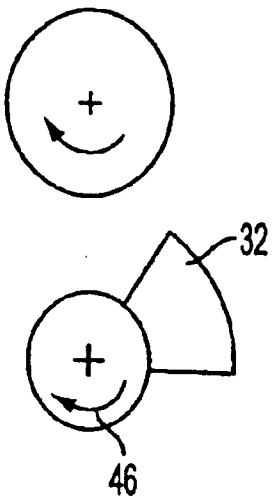

As the roll 26 continues to turn in a counterclockwise direction (from the position shown in FIG. 2*e* to that shown in FIG. 2*f*), the surface 34 moves away from contact with the underside of the web 18 (see FIG. 2*f*) and is simultaneously decelerated to come to a halt in the angular position of FIG. 2*g*. The next step involves a reversal of the direction of operation of the motor M6 so that the roll 26 begins to turn in a clockwise direction (see the arrow 46 in FIG. 2*g*) and moves to the position of FIG. 2*h* which is or can be identical with that shown in FIG. 2*a*. The roll 26 can remain in such (starting) position until the supply of the web 18 is nearly exhausted so that the trailing end of the web 18 must be spliced to the leader of a fresh web (not shown) which, in the meantime, has replaced the remnant of and the core for the web 2. The extent of angular displacement of the roll 26 from the position of FIG. 2*f* to that of FIG. 2*g* can amount to approximately 300°. In FIG. 2*g*, the segment 32 can assume a 2 o'clock position or is close to such position prior to turning in the direction of arrow 46 (FIG. 2*g*) to the position of FIG. 2*h*, i.e., back to the 6 o'clock position of FIG. 2*a* or close to such position.

Figure 3:
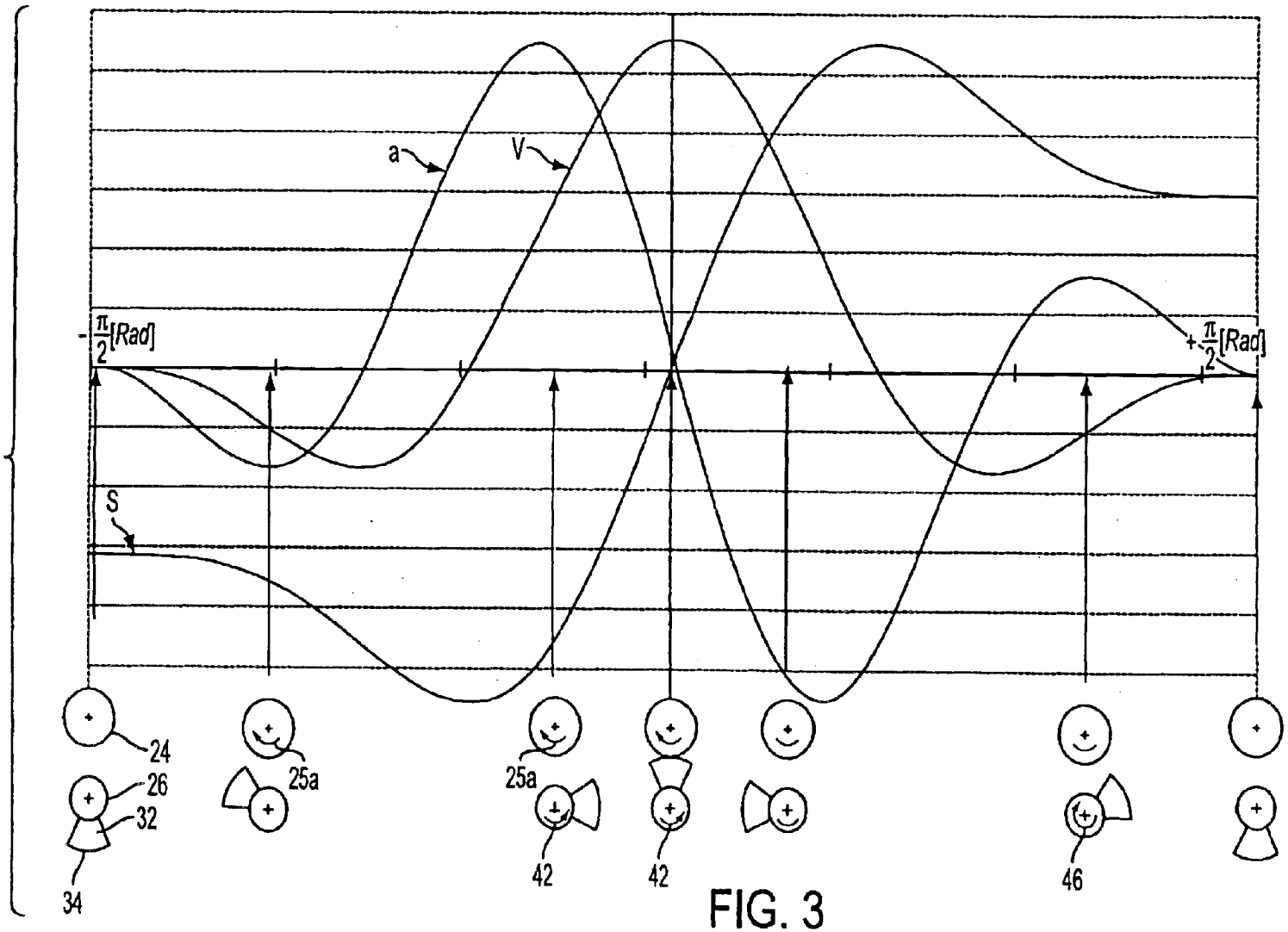
FIG. 3 is a diagram showing the relationship between the speeds and accelerations of and the distances covered by the splicing instrumentalities prior to, in the course of and subsequent to splicing of the leader of the fresh web to the trailing end of the expiring web.

The manner in which the control unit 55 regulates the operation of the motors M1 to M4 and M6 is illustrated in a different way in FIG. 3. More specifically, FIG. 3 shows the harmonic timely progress of the position or distance s, of acceleration a and the velocity v of the knurling surface 34 of segment 32 relative to the roll 24 and its countersurface 28. The progress of movement of the surface 34 relative to the roll 24 is based on a sine wave with two uneven first upper waves. Control of movement of the surface 34 on the segment 32 is carried out by a curve-based regulating unit which is derived from a sine. Such mode of regulation takes into consideration the mass inertia of the segment (32) to be accelerated so that this segment is moved with minimal amounts of wear and noise. The mass of the segment 32 is accelerated optimally from a stable condition of standstill, by taking into consideration the available distance, to a high peripheral speed which corresponds to (i.e., which is required for) high or very high present-day speeds of movement of the webs 2, 18 and so on. During splicing of expiring and fresh webs to each other, the mass of the segment 32 is caused to move, without vibration and/or other stray movements, in synchronism with the speed of the webs. When the splicing operation is completed, the segment 32 is brought back to the position of standstill (see also FIGS. 2*a* and 2*h*) by full consideration of the available distances. This is accomplished by resorting to a regulating method which proceeds harmonically to thus excite the mass in such a way that the mass is capable of mechanically following the movement. To this end, the method of the invention resorts to a control curve which is derived from a sine and the first two uneven harmonics in the range of between $-\pi/2$ and $+\pi/2$ so that the control curve s can be described by the equation $s \cong a.\sin(t)+b.\sin(3t)+c.\sin(5t)$, wherein t is time and a, b and c are constants. This allows for the determination of velocity $v=\Delta s/\Delta t$ and of the acceleration $a=\Delta v/\Delta t$.

An important advantage of the method and apparatus of the present invention is that the turning of the segment 32 in the direction of arrow 38, i.e., from the angular position of FIG. 2*a* to that of FIG. 2*b*, renders it possible to lengthen the path (see the arrows 40 and 42 in FIGS. 2*c* and 2*d*) which is available for acceleration of the segment 32 to the common or practically common forward speed of the webs 2, 18 in the direction of the arrow 22 when the splicing operation is to begin. This ensures that the webs 2, 18 can advance at a high speed (because there is ample room for acceleration of the knurling surface 34 to such speed) as well as that the speed of the surface 34 can exactly match the then common speed of the webs 2, 18 in the direction of the arrow 22. It will be noted that such advantages can be achieved even though the extent of angular movement of the segment 32 from the position of FIG. 2*b* to the position of FIG. 2*e* need not amount to a full revolution (as already mentioned hereinbefore, such angular movement need not exceed, or need not appreciably exceed, 300°).

Figure 2F:
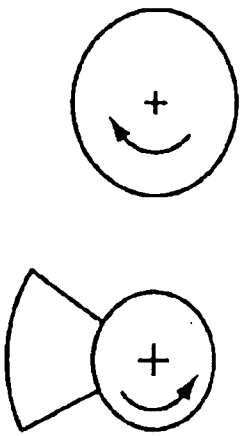
Figure 2E:
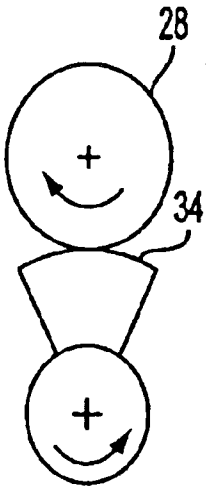

The deceleration of the segment 32 upon completion of the splicing operation, i.e., a counterclockwise turning from the angular position between those shown in FIGS. 2*e* and 2*f* to the position of FIG. 2*g*, can cover an angle of up to 300° (i.e., less than one full revolution) and is followed by a clockwise rotation (arrow 46 in FIG. 2*g*) back to the idle starting position of FIGS. 2*h* and 2A. When in the position of FIG. 2*h* or 2*a*, the segment 32 is located at a maximum distance from the splicing station (such station is located at the tip of the arrow 50 shown in FIG. 4). This is a desirable safety factor because the component parts 24, 32 of the splicing implement are least likely to effect an untimely splicing of the webs 2, 18 to each other.

When the segment 32 assumes the idle position of FIG. 2*b* and/or 2*g*, its arcuate knurling surface 34 is preferably located at a short (such as minimal) distance from the splicing station and from the path of the fresh web 18 shown in FIGS. 1 and 2*a* but is still out of contact with such fresh web. This, too, lengthens the path which is available for acceleration of the segment 34 preparatory to start of a splicing operation and for deceleration (braking) of such segment upon completion of a splicing operation. In other words, such arrangement even further ensures that the convex surface 34 of the segment 32 contacts the web 18 only in the course of the splicing operation.

An advantage of that part of the splicing tool which includes the rotary roll 26 and the segment 32 is that it allows for cooperation with the even less complex complementary component 24 of the splicing tool without affecting the quality of the splicing operation. The dimensions and finish of the surface 34 on the segment 32 determine the length of the splice SP (FIG. 5*c*) as well as its quality (strength).

Figure 4:
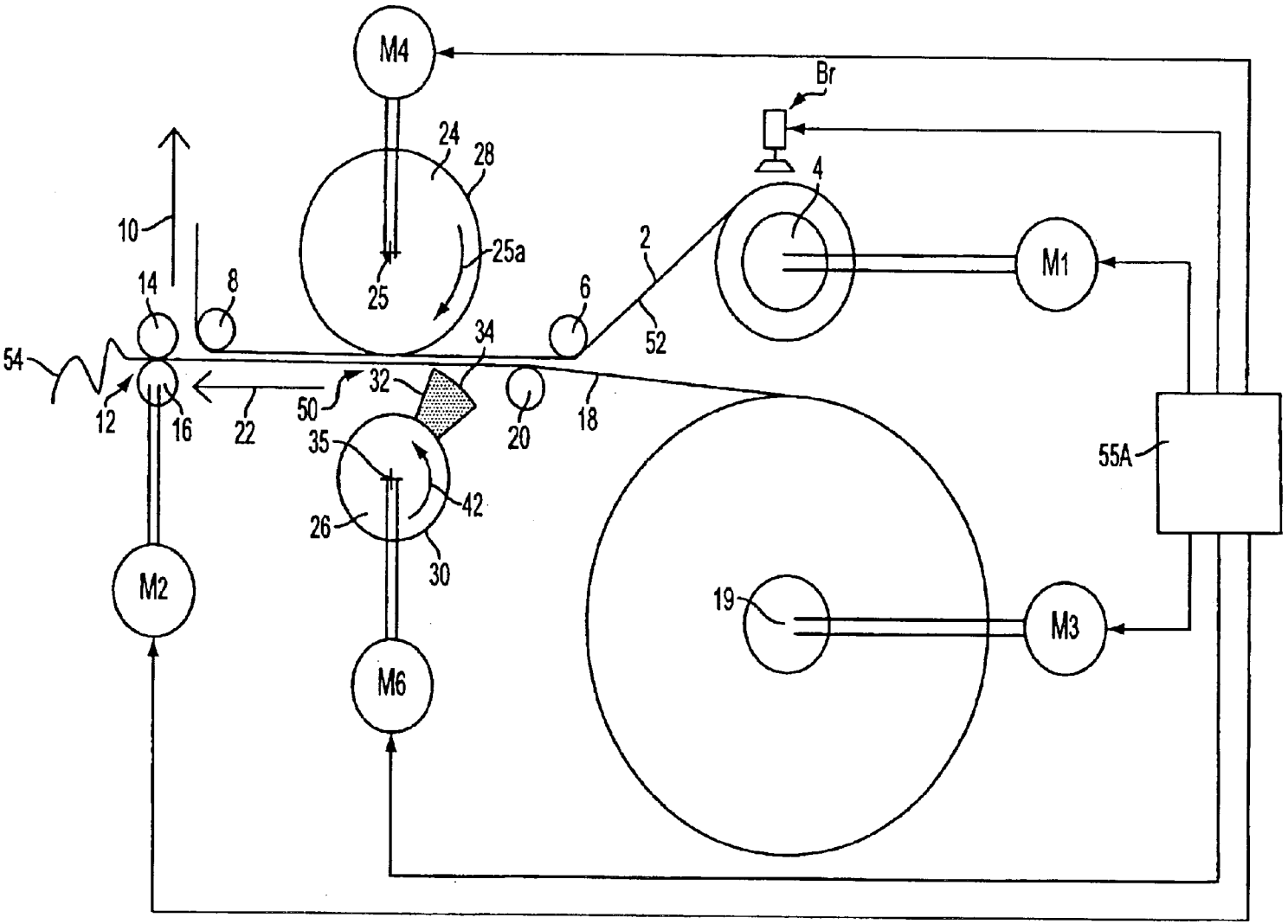
FIG. 4 is a schematic elevational view of a modified apparatus.

FIG. 4 illustrates certain relevant features of a modified apparatus. All such parts of this modified apparatus which are identical with or clearly analogous to the corresponding parts of the apparatus shown in FIGS. 1 to 3 are denoted by similar reference characters. The operation of this modified apparatus of FIG. 4 will be described in detail only insofar as it departs from that of the apparatus of FIGS. 1 to 3. The roll 24 has a rotary peripheral countersurface 28 which is smooth and cooperates with the knurled convex surface 34 of the segment 32 on the roll 26 to carry out a splicing operation when the supply of expiring web 2 on the roll 4 is reduced to a predetermined minimum value. The motor M4 is set up to drive the countersurface 28 at the speed of forward movement of the expiring web 2 under the action of the motor M1 when the splicing operation is to proceed. The axis (25) of rotation of the roll 24 is parallel to the axis (35) of rotation of the roll 26 which carries the segment 32 and can be driven (clockwise as well as counterclockwise) by the motor M6. The surfaces 28, 34 cooperate to form a splice when the speed of these surfaces matches that of the web portions between the rollers 24, 26 and the knurled convex surface 34 contacts the adjacent exposed side of the leader of the fresh web 18.

The distance between the axes 25 and 35 is selected in such a way that the surfaces 28, 34 can provide a knurled splice in automatic response to counterclockwise turning (arrow 42) of the segment 34 beyond the angular position which is shown in FIG. 4.

The control unit 55A of FIG. 4 is operatively connected with the five motors M1 to M4 and M6. This control unit comprises a memory for the program which is selected to control the operation of the motors, as well as a microprocessor which is connected with the motors and with a brake Br for the expiring reel 4.

The speed of at least one of the rolls 24, 26 (e.g., of the roll 24) is regulated in such a way that the speed of the surface 28 matches or at least closely approximates that of the convex surface 34 while the apparatus of FIG. 4 is in the process of splicing the trailing end of the expiring web 2 to the leading end of the fresh web 18. FIG. 4 shows the surfaces 28, 34 in the positions they assume just prior to start of the splicing operation, i.e., the segment 32 is in the process of advancing (counterclockwise as indicated by the arrow 42) toward the position denoted by the arrow 50, namely at a minimum distance from the peripheral surface 28 of the roll 24. Once the segment 32 reaches the position at the head of the arrow 50, the surface 34 is sufficiently close to the surface 28 to deform (knurl) the adjacent portion of leading end of the fresh web 18 and to urge it against the trailing end of the expiring web 2 so that the two ends are reliably spliced to each other. The roll 24 acts as a mobile anvil which determines the position of adjacent portion of the expiring web 2 in the course of the splicing operation.

As a rule, a splicing operation entails the formation of a tail end or remnant 52 which is an integral part of the expiring web 2 and is located behind the splice that connects the webs 2, 18 to each other. Furthermore, each splicing operation normally entails the making of a leader 54 which is a part of the fresh web 18 and is located ahead of the freshly formed splice between the webs 2, 18. The leader 54 extends through the nip of the rollers 14, 16 and advances in a direction to the left, as seen in FIG. 4 (see the arrow 22). It is advisable to remove the parts 52, 54 so that they cannot advance with the fresh web 18, namely into the web processing or consuming machine. This would render it necessary to provide the consuming or processing machine with means for detecting and segregating smokers' products which carry the parts 52 and/or 54. Penetration of the parts 52 and/or 54 into the processing or consuming machine could entail or necessitate a slowdown or even a temporary stoppage of such processing or consuming machine for the purpose of removing defective wrapped products.

Figure 5C:
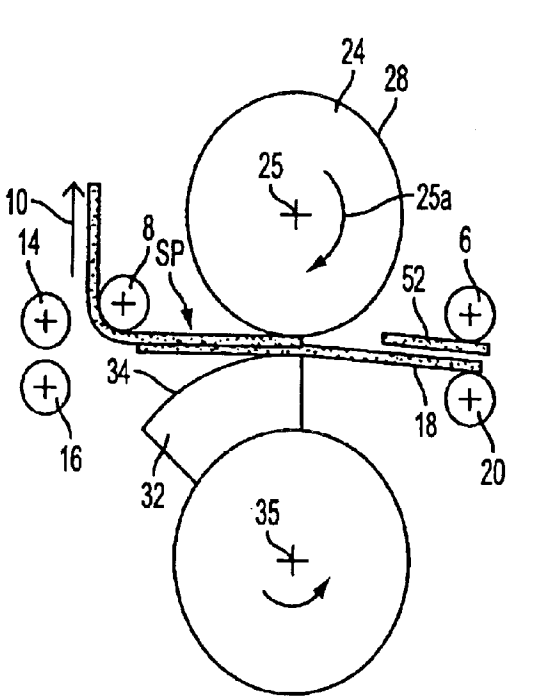
FIG. 5*c* is a view similar to that of FIG. 5*a* or 5*b* but showing the mode of tearing the remnant of the trailing end of the expired web from the spliced-together webs behind the splice.
Figure 5B:
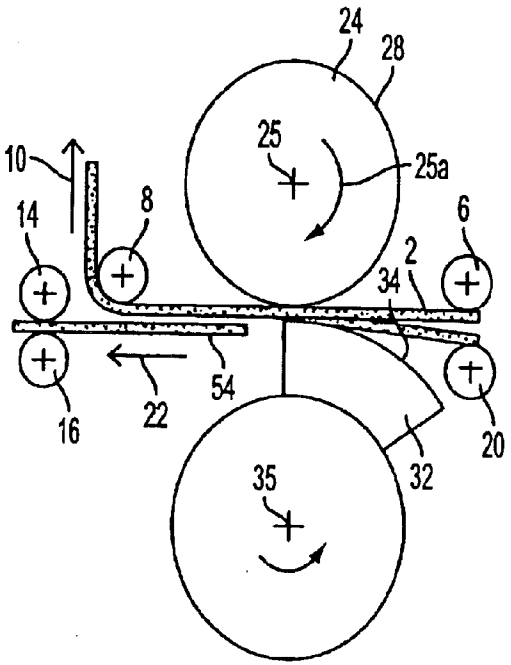
FIGS. 5*a* and 5*b* illustrate, partly on a larger scale, certain details in the apparatus of FIG. 4 during separation of the leader of the front end of the fresh web from the spliced-together webs.
Figure 5A:
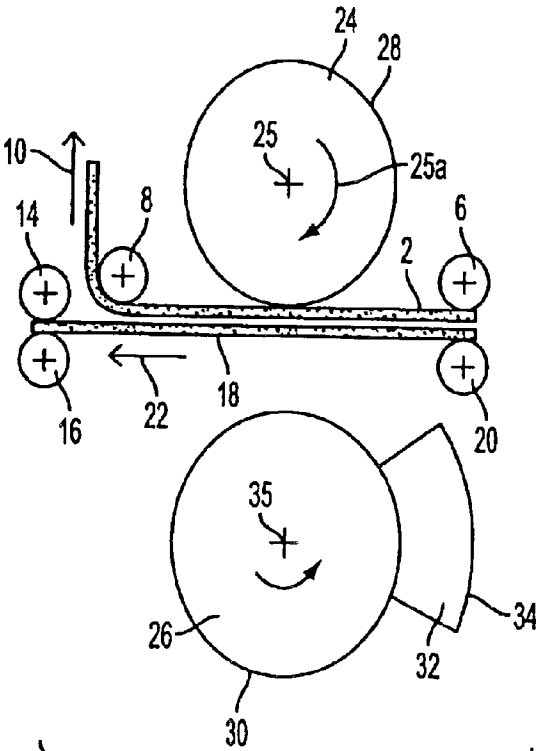

The manner in which the parts 52, 54 can be segregated in the apparatus of FIG. 4 is illustrated in FIGS. 5*a*, 5*b* and 5*c*. More specifically, FIGS. 5*a* and 5*b* show the mode of segregating and removing the part 54 (i.e., the part of the fresh web 18 ahead of the splice between the webs 2, 18). This is accomplished in that, during actual making of a splice (see FIG. 5*b*), the motor M2 accelerates the rollers 14, 16 so that the leader 54 is torn off the fresh web 18 immediately ahead of the foremost part of the splice between the webs 2 and 18. The part 54 is torn off the freshly formed splice because the peripheral speed of the rollers 14, 16 then exceeds the speed of the surfaces 28 and 34.

FIGS. 5 and 5*c* illustrate the manner of separating the remnant 52 of the web 2 from the spliced-together webs 2 and 18. To this end, the control unit 55A actuates a suitable brake Br which decelerates the expired or expiring roll 4 and hence the remnant 52 shortly or immediately prior to completion of the splice SP (see FIG. 5*c*), i.e., shortly before the trailing end of the arcuate surface 34 advances beyond the locus denoted by the head of the arrow 50 shown in FIG. 4. Such deceleration entails a tearing of the remnant 52 off the spliced-together webs 2 and 18 because the decelerating force being applied by the brake Br to the remnant 52 exceeds the tear strength of the web 2.

The separation (tearing) of the leader 54 and of the remnant 52 from the spliced-together webs 2, 18 takes place at the respective ends of the freshly formed splice SP because the contact between the knurled surface 34 and the material running along the path from the roller 6 to the roller 8 weakens, at least slightly, the web 2 up to the trailing end of the freshly formed splice SP, and the web 18 up to the leading end of the splice. The brake Br is actuated simultaneously with a deceleration of the motor M1 for the expiring reel 4 to separate the remnant 52 from the splice SP, and the motor M2 for the rollers 14, 16 is accelerated when the forward end of the knurling surface 34 reaches the splicing station denoted by the arrow 50; this entails the tearing of the leader 54 from the main portion of the fresh web 18 at the forward end of the splice SP.

The making of the leader 54 and/or of the remnant 52 is attributable, at least to a certain extent, to the high speeds of the webs 2, 18, etc. in modern high-speed cigarette making and other machines wherein a wrapping mechanism or another web processing mechanism must receive a continuous (composite) web at a high or very high speed. Removal of such surplus material at the front and rear ends of the splice SP is desirable and advantageous because it reduces the likelihood of malfunctioning of the web processing machine. It has been found that the aforedescribed modes of separating the leader 54 and the remnant 52 by tearing, i.e., by changing their speed relative to the finished splice and/or vice versa, ensures a highly reliable segregation because the making of a splice SP automatically weakens the line of connection between the splice and the leader 54 as well as the line of connection between the splice and the remnant 52. Stretching of the web 2 at the junction of the remnant 52 with the splice SP can begin during the making of the splice, and the same holds true for the stretching of the junction between the splice and the leader 54. This can be seen in FIG. 5*c* wherein the leader 54 is already torn off the major part of the fresh (rear) web 18 even though the tool 24, 32 has merely begun to make the splice SP.

An advantage of the separation of surplus web material by tearing is that one can dispense with the utilization of knives and/or other severing tools which must be adjusted, sharpened and/or replaced at frequent intervals and can interfere with convenient threading of webs into the splicing arrangement. Moreover, the improved surplus removing assembly is simple, compact and inexpensive and can stand long periods of use. For example, the arrangement of FIGS. 4 and 5*a*–5*c* actually requires a single additional part, namely the brake Br.

The motor M4 constitutes a preferred but optional feature of the invention. Thus, the roll 24 can be accelerated to the speed of the web 4 between the rollers 6 and 8 by this web rather than by the motor M4, as long as the surface 28 rotates at a speed at least close to the speed of the web 4 when the web 18 is being contacted by the properly accelerated convex surface 34 in the course of the actual splicing or knurling operation.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of splicing running webs of paper or the like and, therefore, such adaptations should and are intended to be comprehended within the meaning and range of equivalence of the appended claims.

What is claimed is:

1. A method of splicing the trailing end of an expiring running web to the leading end of a fresh running web, comprising the steps of:

advancing the leading and trailing ends in at least substantial parallelism with and next to each other at an at least substantially identical speed and in a predetermined direction along a path flanked by a rotary arcuate knurling surface and a rotary counter-surface;

moving the knurling surface counter to said direction while maintaining the knurling surface out of contact with the webs in said path;

thereupon turning the knurling surface in said direction and simultaneously accelerating the knurling surface at least close to said speed; and thereafter pressing the leading and trailing ends against each other by and between said surfaces.

2. The method of claim 1, wherein the webs form part of and are being paid out by discrete expiring and fresh bobbins of convoluted webs.

3. The method of claim 1, wherein the webs consist of wrapping material for smokers' products.

4. The method of claim 1, wherein at least one of (a) the speed of accelerated knurling surface, (b) the acceleration of the knurling surface, and (c) the position of the knurling surface vary as a function of time with a harmonic progress adapted to be represented essentially by a sinusoidal function.

5. The method of claim 4, wherein said harmonic progress of the position of the knurling surface is adapted to be represented by a function $$s\ a.\sin(t)+b.\sin(3t)+c.\sin(5t),$$

wherein t is the time and a, b and c are constants.

6. The method of claim 1, wherein said step of moving the knurling surface counter to said direction includes causing the knurling surface to turn through an angle of less than 360°.

7. The method of claim 1, wherein said step of moving the knurling surface includes moving the knurling surface along an at least substantially circular path.

8. The method of claim 1, wherein said accelerating step results in movement of the knurling surface in at least substantial synchronism with the webs in the course of said pressing step.

9. The method of claim 1, wherein said step of turning the knurling surface includes accelerating the knurling surface to at least close to said at least substantially identical speed at least substantially independently of the countersurface.

10. The method of claim 1, wherein said steps of moving and turning the knurling surface include (a) moving the knurling surface from a starting position counter to said predetermined direction to a first intermediate position, (b) turning the knurling surface from said first intermediate position in said predetermined direction and simultaneously accelerating the knurling surface to at least close to said at least substantially identical speed not later than when the knurling surface reaches said path, (c) decelerating the knurling surface while moving the latter to a second intermediate position, and (d) thereafter moving the knurling surface to a final position.

11. The method of claim 10, wherein said final position at least substantially coincides with said starting position.

12. The method of claim 10, wherein the knurling surface is disposed at a maximum distance from said path while occupying at least one of said starting and final positions.

13. The method of claim 10, wherein the knurling surface is disposed at a minimum distance from said path while occupying at least one of said intermediate positions.

14. The method of claim 13, wherein the knurling surface is out of contact with the webs in said path while occupying said at least one intermediate position.

15. The method of claim 1, wherein said pressing step entails the provision of at least one remnant which is of one piece with one of the webs, and further comprising the step of separating the at least one remnant from the spliced-together webs.

16. The method of claim 15, wherein said separating step includes tearing the at least one remnant from the spliced-together webs.

17. The method of claim 16, wherein said tearing step includes moving the at least one remnant at a first speed and moving the spliced-together webs at a different second speed.

18. The method of claim 17, wherein said second speed exceeds said first speed.

19. The method of claim 15, wherein said separating step includes braking the at least one remnant relative to the spliced-together webs.

20. The method of claim 15, wherein said advancing step includes moving the ends of the webs at a first speed and said separating step includes accelerating the at least one remnant to a speed exceeding said first speed.

21. The method of claim 20, wherein accelerating step is started during a stage including one of (a) said pressing step, and (b) subsequent to completion of said pressing step.

22. Apparatus for splicing the tailing end of an expiring running web to the leading end of a fresh running web while the leading and trailing ends advance next to each to other, in the same direction and at an at least substantially identical speed along a predetermined path, comprising:

a rotary splicing member adjacent one side of said path and having a web knurling surface;

regulatable drive means for said splicing member;

means for regulating said drive means to move said knurling surface counter to said direction while maintaining the knurling surface out of contact with the webs in said path, to thereupon turn said knurling surface in said direction and toward said path with simultaneous acceleration of said surface at least close to said at least substantially identical speed and to thereafter move the thus accelerated knurling surface in said direction against and with one of the webs in said path.

23. The apparatus of claim 22, wherein said splicing member includes a segment rotatable about a predetermined axis and having a convex radially outermost surface including said knurling surface.

24. The apparatus of claim 23, further comprising a second splicing member having a second surface movable along and contacting the other web at the other side of said path opposite said first mentioned splicing member at least while said knurling surface contacts the one web in said path.

25. The apparatus of claim 24, wherein said second splicing member includes a roll rotatable about a second axis and having a peripheral surface including said second surface.

26. The apparatus of claim 22 for splicing the trailing end of an expiring running web to the leading end of a fresh web wherein at least one of the webs includes a remnant extending beyond the spliced-together portions of the webs in said path, further comprising means for separating the remnant of the at least one web not later than upon completed splicing of the webs to each other.

27. An apparatus for splicing the trailing end of an expiring running web to the leading end of a fresh running web while the leading and trailing ends advance next to each other, in the same direction and at an at least substantially identical speed along a predetermined path, comprising:

a rotary splicing member adjacent one side of said path and having a web knurling surface;

regulatable drive means for said splicing member;

means for regulating said drive means to move said knurling surface in a first direction away from said path, to thereupon move said surface in a second direction counter to said first direction and toward said path with simultaneous acceleration of said surface at least close to said at least substantially identical speed, and to thereafter move the thus accelerated knurling surface in said second direction against and with one of the webs in said path; and means for separating a remnant of at least one web not later than upon a completed splicing of the webs to each other wherein at least one of the webs includes the remnant extending beyond the spliced-together portions of the webs in said path, and said separating means includes means for tearing the remnant from the at least one web.

28. The apparatus of claim 27, wherein said tearing means includes means for moving the remnant of the at least one web and the spliced-together portions of the webs relative to each other at different speeds.

29. The apparatus of claim 26, further comprising a second rotary splicing member, said path being disposed between said splicing members.

30. The apparatus of claim 29, wherein each of said splicing members includes a roll, said rolls being rotatable about at least substantially parallel axes.

31. The apparatus of claim 30, wherein said first mentioned splicing member further includes a segment borne by the respective roll, said knurling surface being provided on said segment.

32. The apparatus of claim 31, further comprising second drive means for the expiring web and third drive means for the fresh web, said separating means including a brake actuatable by said regulating means to oppose advancement of a remnant of the expiring web by said second drive means and being arranged to separate a remnant from the fresh web by way of said third drive means.

33. The apparatus of claim 32, wherein said regulating means is arranged to accelerate a remnant from the fresh web by way of said third drive means.

* * * * *